US005385281A

United States Patent [19]

Byrd

[11] Patent Number: 5,385,281

[45] Date of Patent: Jan. 31, 1995

[54] PAINTER'S UTILITY BELT

[76] Inventor: Charles L. Byrd, 260 Millhouse Rd., Bell Buckle, Tenn. 37020

[21] Appl. No.: 231,786

[22] Filed: Apr. 25, 1994

[51] Int. Cl.[6] ..... A45F 3/16; A41D 13/04

[52] U.S. Cl. ..... 224/148; 224/224; 224/250; 224/904; 2/51

[58] Field of Search ..... 224/148, 191, 250, 251, 224/253, 255, 224, 227, 270, 904; 2/48, 50, 51

[56] References Cited

U.S. PATENT DOCUMENTS

| | | | |
|---|---|---|---|
| 1,109,161 | 9/1914 | Chindgren . | |
| 1,292,728 | 1/1919 | Dozier | 224/253 |
| 1,600,027 | 9/1926 | Welsand . | |
| 2,315,095 | 3/1943 | Rhodes | 224/227 |
| 2,388,811 | 11/1945 | Zatco . | |
| 2,524,639 | 10/1950 | Saunders . | |
| 2,629,102 | 2/1953 | Howells . | |
| 2,945,614 | 7/1960 | Wittmann, Sr. | 224/148 |
| 3,004,315 | 10/1961 | Masure | 2/51 |
| 3,274,476 | 9/1966 | Wildum . | |
| 3,535,709 | 10/1970 | Johannes . | |
| 3,997,092 | 12/1976 | Pogwizd . | |
| 4,220,302 | 9/1980 | Hampton et al. | 224/148 |
| 4,325,503 | 4/1982 | Swinney . | |
| 4,363,433 | 12/1982 | Jaques . | |
| 4,449,654 | 5/1984 | Cappis . | |
| 4,830,247 | 5/1989 | Banks | 224/904 |
| 4,867,358 | 9/1989 | Bennis . | |
| 4,867,360 | 9/1989 | Howard . | |
| 4,972,982 | 11/1990 | Harbour | 224/270 |
| 5,003,634 | 4/1991 | Brinkman . | |
| 5,016,791 | 5/1991 | Burow . | |
| 5,060,835 | 10/1991 | Payne . | |
| 5,163,591 | 11/1992 | Leiserson . | |
| 5,240,158 | 8/1993 | Walsh . | |

FOREIGN PATENT DOCUMENTS

| | | | |
|---|---|---|---|
| 722496 | 11/1965 | Canada . | |
| 337976 | 7/1919 | Germany . | |
| 166197 | 2/1959 | Sweden | 224/148 |
| 64747 | 3/1913 | Switzerland . | |

*Primary Examiner*—Henry J. Recla
*Assistant Examiner*—Gregory M. Vidovich
*Attorney, Agent, or Firm*—Richard C. Litman

[57] ABSTRACT

A painter's utility belt provides for the carriage of at least one paint can and a variety of additional tools and equipment likely to be needed by a painter. The belt includes a first loop which may be secured about a paint can below the bail lugs on the sides of the can to support the can from the belt, and a second loop which may be secured about a section of PVC pipe or the like to provide for the storage of a caulking gun or the like therein. The loops are openable and adjustably closeable for different sizes of containers or the like, and are offset from the center of the belt to preclude interference with a ladder or other structure directly to the front of a wearer of the belt. An apron portion is also provided, with the apron having a plurality of open pockets of different sizes therein for the storage of various tools and articles. The device may be made of a variety of natural or synthetic materials; preferably, the belt and loop portions are formed of polypropylene, while the apron portion is formed of canvas. The belt and loops may be secured by a side latch buckle or the like; other alternatives are possible also.

17 Claims, 2 Drawing Sheets

PAINTER'S UTILITY BELT

FIELD OF THE INVENTION

The present invention relates generally to belts and carriers adapted to specialized uses and trades, and more specifically to a utility belt providing for the carriage of at least one can of paint, as well as other articles commonly used in the painter's trade.

BACKGROUND OF THE INVENTION

Professional house painters and the like in the building construction and/or maintenance fields, spend a great deal of their time on ladders, scaffolds or other elevated places in order to reach the upper levels of the structure being painted. While some such ladders and scaffolds may have shelves or the like for the placement of painter's supplies, many ladders (particularly extension ladders) do not. Even in the case of scaffolding, the supplies (paint, brushes, scrapers, rags, etc.) will be placed at foot level, which necessitates a great deal of bending and lost time for the painter as he/she trades off one tool for another. Invariably, a painter finds some areas of loose paint or debris which must be scraped, brushed, or dusted away while involved in the painting process, even if such preparatory work was undertaken earlier. If the tools for such work are on the ground or otherwise inconveniently located, further time is lost gathering the proper tools and then retrieving the paint can and brush to continue painting.

The need arises for a utility belt for painters, which belt is capable of carrying not only a can of paint, but also such articles and tools as scrapers, wire brushes or the like, rags, etc., as well as a caulking gun for touchup work as needed during painting. The belt should be easily adjustable for differently sized persons, as well as different sizes of paint cans, and should be adaptable to either left or right handed use by a painter.

DESCRIPTION OF THE PRIOR ART

Numerous specialty belts and the like have been developed over the years, a number of which applicant is aware. However, a review of each of these does not appear to show any similarity to the painter's utility belt of the present invention. The following U.S. and foreign patents have been uncovered in patentability searches relating to such belts.

U.S. Pat. No. 1,109,161 issued to Gustaf Chindgren on Sep. 1, 1914 discloses a Paint Can Carrier having a plurality of basket-like carriers thereon, each formed of a series of metal straps. An inflexible metal shelf is secured to a flexible belt, with the carriers affixed to the metal shelf. No separate pockets or protective apron are disclosed, nor is any adjustability provided for differently sized or shaped cans, as in the present invention.

U.S. Pat. No. 1,600,027 issued to John A. Welsand on Sep. 14, 1926 discloses a Climber's Belt which includes various attachments for different tools. While the belt also includes at least one loop for the carriage of an article therein, the loop is non-adjustable, and no pockets or protective apron are provided.

U.S. Pat. No. 2,388,811 issued to Michael Zatco on Nov. 13, 1945 discloses a Welder's Comforting And Accessory Suspension Belt. While the belt discloses plural loops thereon, the loops are of fixed length and cannot be opened or adjusted, as can the loops of the present belt. No pockets or apron are disclosed by Zatco.

U.S. Pat. No. 2,524,639 issued to Glenn C. Saunders on Oct. 3, 1950 discloses a Container Support comprising a rigid strap with two adjustable loops extending therefrom. The rigid strap supports the bottom of a container inserted in the loops, whereas the present invention does not require a bottom support. No other attachments are disclosed, nor are any pockets or apron.

U.S. Pat. No. 2,629,102 issued to Llewellyn W. Howells on Feb. 24, 1953 discloses a Butcher's Apron With Spacing Band comprising a single sheet of material outwardly spaced from a belt. No pockets or additional straps or the like for the carriage of any articles, are disclosed.

U.S. Pat. No. 3,004,315 issued to Joel Masure on Oct. 17, 1961 discloses Snap-On Aprons comprising a pocketed apron with at least two snaps along the upper edge thereof. Plural loops are provided for attachment to an existing belt, with the loops including mating snap members to provide for the attachment of the apron thereto. No belt is permanently secured to the apron, nor are any additional straps disclosed for the carriage of other articles (e.g., paint cans).

U.S. Pat. No. 3,274,476 issued to Paul Wildum on Sept. 20, 1966 discloses an Article Carrying Belt for the purpose of carrying electrical storage batteries. The device basically comprises a series of completely closable pockets, with access to the pockets through a zipper along the back or inside surface of the belt. The closed pockets would be unsuitable for use with the present invention, where ready access to the contents of a can must be provided. Furthermore, no apron is provided.

U.S. Pat. No. 3,535,709 issued to John H. Johannes on Oct. 27, 1970 discloses a Painter's Apron having a single, semirigid, open container at the front thereof for the containment of paint directly therein. The apron portion extends above the belt and is secured about the user's neck, whereas only the container extends below the belt. Although a vertical stiffener is provided, no horizontal or vertical adjustable straps or loops are provided for the carriage of paint cans or the like.

U.S. Pat. No. 3,997,092 issued to Kenneth W. Pogwizd on Dec. 14, 1976 discloses a Paint Container Carrier having a specially shaped, rigid container for the carriage of a paint can therein. The container also has a closable lid and adapters providing for the carriage of differently sized cans. While clips are provided for the carriage of certain tools, other tools which do not adapt to such clips cannot be carried, as no pockets are provided. The device requires a neck strap as well as a belt for securing to the user.

U.S. Pat. No. 4,325,503 issued to Glen E. Swinney on Apr. 20, 1982 discloses a Painter's Belt-On Brush And Bucket Holder And Carrier. The device is essentially a rigid frame, unlike the flexible composition of the present belt. A lip is provided at the bottom of the frame for the support of the bottom rim of a can, and a hook is provided near the top of the frame for the bail of the can. The distance between the lip and hook are fixed, which limits the device to use with only a single size and configuration of can. No apron or pockets for other articles are disclosed.

U.S. Pat. No. 4,363,433 issued to Dean Jaques on Dec. 14, 1982 discloses a Painter's Holster comprising a paint bucket with brush holders on at least one side thereof. Loops are provided in the back of the bucket for attachment to a belt. The device is a liquid proof container, open only at the top, as it is intended that the paint be poured directly into the container. No separate pockets for the carriage of other articles, or adjustability for differently sized articles or cans, is disclosed.

U.S. Pat. No. 4,449,654 issued to Lona P. Cappis on May 22, 1984 discloses a Belt Supported Backpack comprising a plurality of open bottomed pockets for the carriage of drink bottles or the like therein. The pockets are secured to a relatively wide sheet of material having closable pockets therein. The plural pockets are not adjustable in size, and extend immediately over the outside surface of the central pocket, unlike the present invention.

U.S. Pat. No. 4,867,358 issued to Paul A. Bennis on Sep. 19, 1989 discloses a Beverage Container Assembly comprising a closed container pivotally attached to a panel, which panel in turn secures to an upper and a lower strap for attachment of the device to a person. The double belt arrangement, closed container, and lack of additional storage pockets are unlike the configuration of the present invention.

U.S. Pat. No. 4,867,360 issued to Brent A. Howard on Sep. 19, 1989 discloses a Cleaning Utility Belt comprising a series of containers disposed along a belt, with additional means for hanging other articles thereon. While some of the containers have open bottoms and some have closed bottoms, none are adjustable for different sizes or diameters of cans which may be placed therein, and no apron or pockets are disclosed.

U.S. Pat. No. 5,003,634 issued to Robert J. Brinkman on Apr. 2, 1991 discloses a Belt Type Garment With Foldable Seat Cover having two relatively wide and shallow pockets, with one overlying the other. One pocket contains a flap which may be folded out to provide protection while seated, while the other provides storage for various articles. No straps or other means are provided for the carriage of containers of any sort, nor are plural pockets provided.

U.S. Pat. No. 5,016,791 issued to Charles F. Burow on May 21, 1991 discloses a Painter's Hip level Pail Carrier comprising a belt having a depending extension, with the extension having a second belt pivotally attached thereto. The second belt may be secured about a paint can, with the bail of the can being secured by an upper latch. The depending extension, while called an "apron" in the Burow patent, is only large enough to include the swivel attachment for the belt and does not include any pockets for additional tools or equipment, as in the present invention. In any event, no access would be provided to the Burow apron, as it is disposed directly behind the paint can.

U.S. Pat. No. 5,060,835 issued to Osamu M. Payne on Oct. 29, 1991 discloses a Belt Type Personal Carrier Apparatus For Conveniently Supporting A Beverage Container And Other Belongings Of A Person About The Person's Waist. The beverage container support comprises at least one strap disposed beneath the container, unlike the present invention, and the container is disposed to one side of the belt with a pouch disposed to the opposite side. No pocketed apron is disclosed, either to the continuous side or the buckle side of the belt, as in the present invention.

U.S. Pat. No. 5,163,591 issued to Steven G. Leiserson et al. on Nov. 17, 1992 discloses a Paint Bucket Holster similar to the Burow and Swinney devices discussed above. While belt loops for tools are disclosed by Leiserson et al., such loops are of limited utility due to their fixed size; no pockets are disclosed.

U.S. Pat. No. 5,240,158 issued to Thomas Walsh on Aug. 31, 1993 discloses a Belt-Type Carrier Device in which one or two adjustable loops are installed on a belt. The two loops include bottom support straps, unlike the present invention. No apron or pockets are disclosed.

Canadian Patent No. 722,496 issued to Robert G. Smith on Nov. 30, 1965 discloses a Wedge Carrier comprising a belt attachable pouch including at least two overlying pockets. No means for the carriage of a paint can or the like is disclosed, nor are the pockets laterally separated as in the present invention.

German Patent No. 337,976 issued to Wilhelm Jacobi on Jul. 5, 1919 discloses a painter's belt having an overlying adjustable strap to secure cans between the strap and belt. A plurality of outwardly extending tabs provides support for the bottoms of the cans. No apron or pockets are disclosed.

Finally, Swiss Patent No. 64,747 issued to Heinrich Warmund on Mar. 11, 1913 discloses a painter's belt having a plurality of open canisters slidably disposed thereon. A series of loops is affixed to the belt for the carriage of brushes and the like. No apron or pockets are disclosed.

None of the above noted patents, taken either singly or in combination, are seen to disclose the specific arrangement of concepts disclosed by the present invention.

SUMMARY OF THE INVENTION

By the present invention, an improved painter's utility belt is disclosed.

Accordingly, one of the objects of the present invention is to provide an improved painter's utility belt which includes first and second openable and closeable, adjustable loops providing for the carriage of a paint can and a caulking gun or the like.

Another of the objects of the present invention is to provide an improved painter's utility belt which includes an apron portion depending from the belt, with the apron portion including a plurality of open pockets of different sizes therein.

Yet another of the objects of the present invention is to provide an improved painter's utility belt which first and second adjustable loops are each disposed to one side of the center of the belt, in order to place the loops and any articles carried therein to one side of the user of the belt.

Still another of the objects of the present invention is to provide an improved painter's utility belt which apron portion is disposed to the center of the belt, in order to place the apron portion directly in front of the user of the belt when the ends of the belt are secured at the center of the user's back.

A further object of the present invention is to provide an improved painter's utility belt which may include at least one vertical strap extending between the belt portion and the lower edge of the apron, for the carriage of additional articles.

An additional object of the present invention is to provide an improved painter's utility belt which may be formed of a variety of natural and synthetic materials, such as canvas for the apron portion and polypropylene for the belt and loop portions.

Another object of the present invention is to provide an improved painter's utility belt which belt portion, first and second loop portions, and vertical strap are adjustably securable by means of a side latch buckle.

A final object of the present invention is to provide an improved painter's utility belt for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENT

Figure 1:
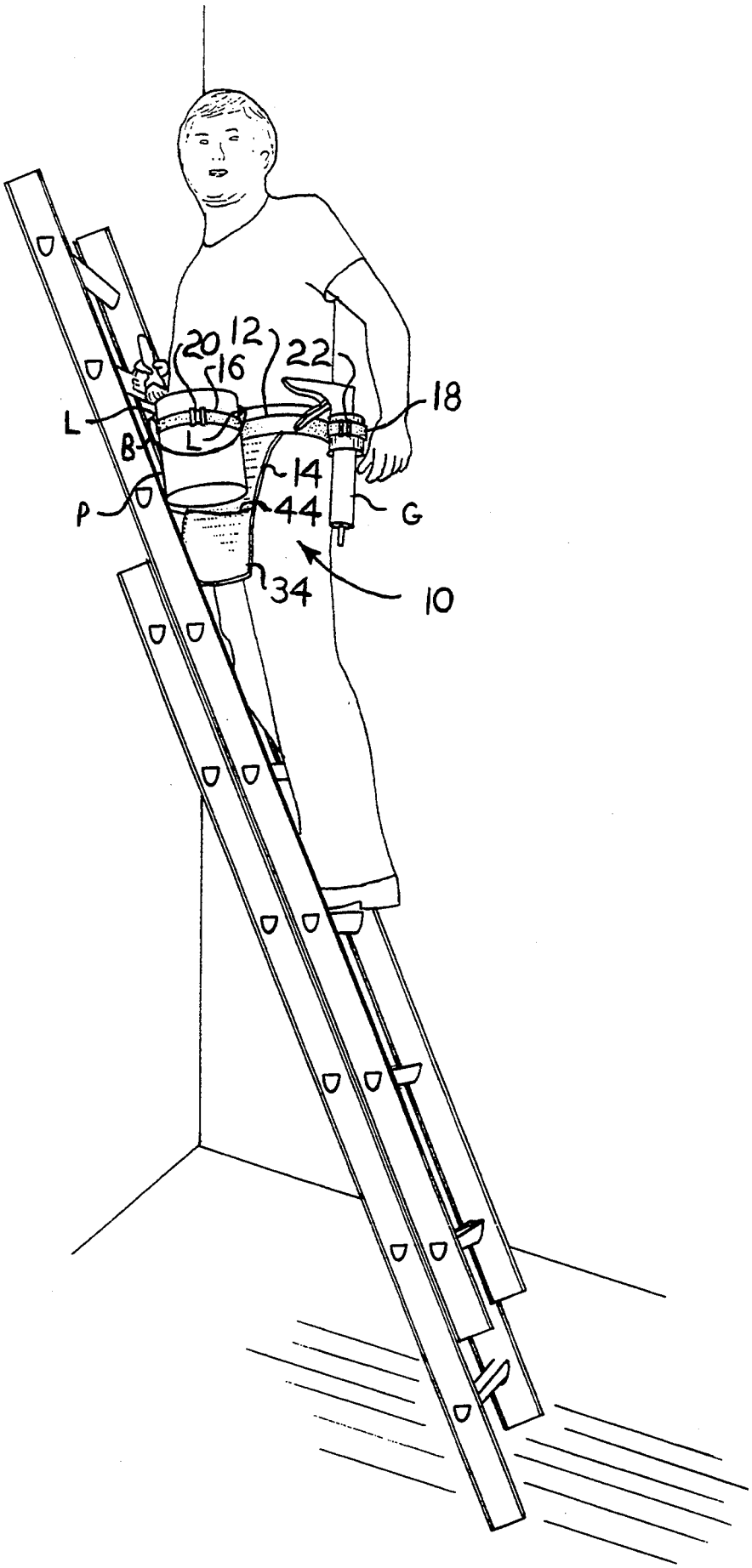
FIG. 1 is a perspective view showing the painter's utility belt of the present invention in use.

Referring now to the drawings, the present invention will be seen to relate to a painter's utility belt 10 providing for the carriage of a paint can or bucket P, as well as other tools and accessories, on the person. The painter's utility belt 10 generally comprises a belt portion 12 and a pocketed apron portion 14, which apron portion 14 depends from the lower edge 15 of the belt portion 12 and is preferably centered on the transverse centerline C of the belt portion 12. The belt portion 12 also includes a relatively larger first loop 16 and a relatively smaller second loop 18 secured to the outer surface 19 thereof.

Figure 2:
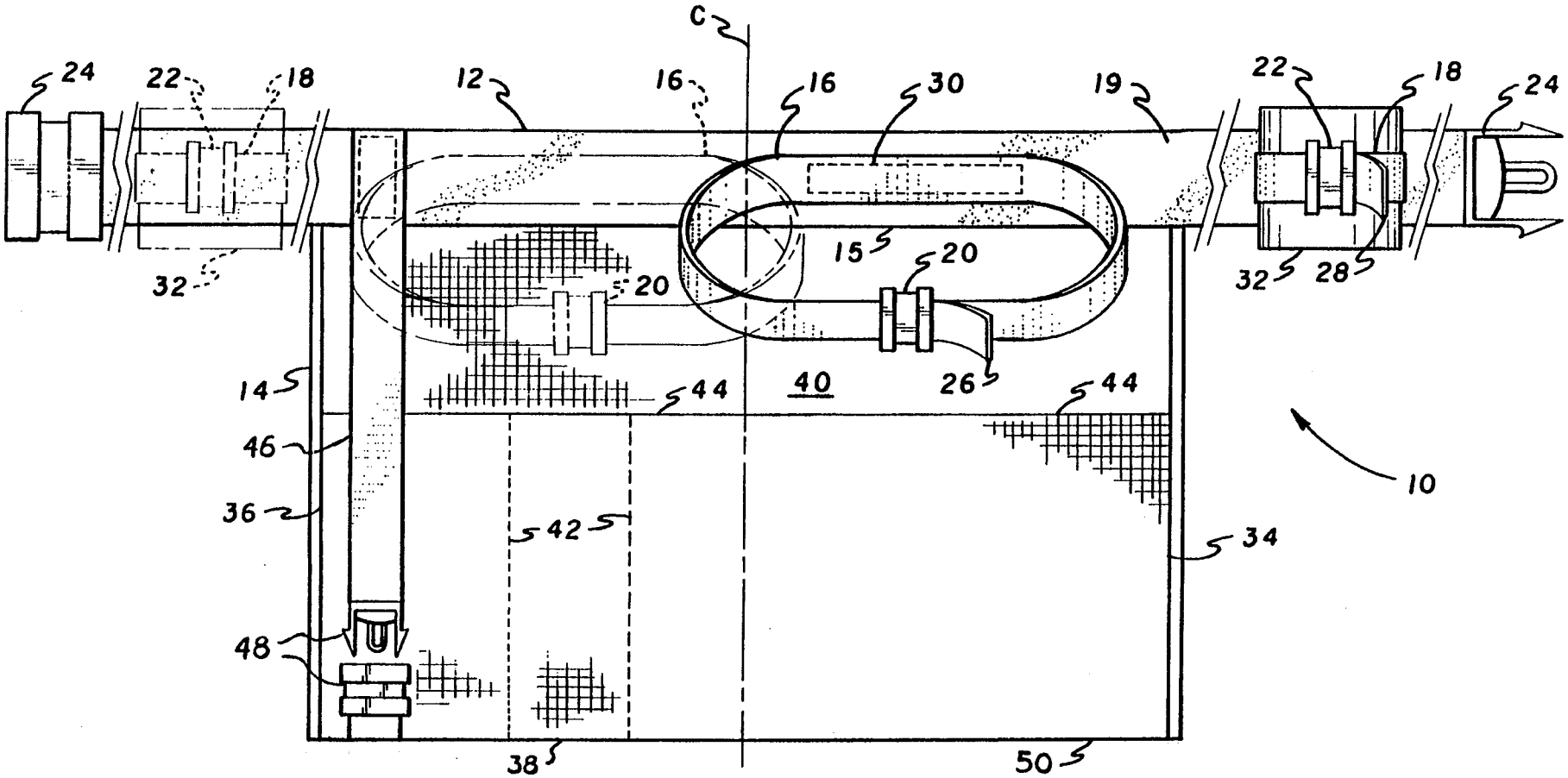
FIG. 2 is a plan view of the belt of the present invention, showing the details of the device.

FIG. 2 of the drawings discloses further details of the present invention. Each of the loops 16 and 18, as well as the belt portion 12, are openable and closeable respectively by means of buckles 20 through 24, which may be side latch type buckles as shown or alternatively another type or types. The side latch type buckles shown have been found to be inexpensive, durable, and resistant to damage from paint and to jamming from dried paint hardening therein, and provide practically infinite adjustment by adjusting the length of the free end of the belt or loop, as with the free ends 26 and 28 of the loops 16 and 18.

Both of the loops 16 and 18 are preferably installed (as by stitching 30, or other suitable means) to the same side of the centerline C of the belt portion 12. In the typical case of a right handed painter, the first loop 16 and second loop 18 are preferably installed to the left side of the centerline C of the belt portion 12, as shown by the loops 16 and 18 shown in solid lines in FIGS. 1 and 2. (The viewer of FIG. 2 faces the front of the belt portion 12 and apron portion 14, with the user's or wearer's left and right being reversed; the belt latch 24 is disposed to the back of the wearer when the present belt 10 is in use.) Typically, a right handed painter will find it easier to reach across his/her front to dip a brush into a paint can P secured to the left side of the body, rather than using a paint can secured to the same side of the body as the painter's brush hand. The same applies for the access of tools held within the second loop 18. The present painter's utility belt 10 may alternatively be assembled with the loops 16 and 18 to the opposite side of the belt centerline C as shown by the loops 16 and 18 in broken lines in FIG. 2, if desired, for easier use by left handed persons.

The loops 16 and 18 are particularly suitable for securing round or cylindrical objects therein, such as a paint can P, as discussed above. The smaller second loop 18 may be used to secure an open ended, relatively inflexible cylindrical object therein, to provide a fixed, open loop therein for the storage of such articles as a caulking gun G or the like, as shown in FIG. 1. It has been found that a section of plastic tube or pipe, such as the section of polyvinyl chloride (PVC) pipe 32 shown secured within the second loop 18, is especially effective in providing for the containment of a caulking gun G therein. The handle and trigger of the caulking gun G preclude passage of the gun G completely through the PVC pipe 32, when the nozzle of the gun G is inserted downward into the loop 18 and pipe 32.

In a like manner, the first loop 16 provides for the secure containment of a paint can or bucket P therein. By passing the ends of the opened loop 16 around the paint can P and below the attachment lugs L for the handle or bail B as shown in FIG. 1, securing the ends of the buckle 20 together and cinching up the loop 16 by drawing the free end 26 until the loop 16 is tightly secured about the can P, the loop 16 provides support for the can P due to the protruding bail lugs L extending over the upper edge of the loop 16. The loop 16 will be seen to be fully adjustable and providing for the secure carriage of various sizes of paint cans, by cinching or tightening the loop 16 as required.

The depending apron portion 14 includes a plurality of pockets, i.e., first, second, and third pockets 34, 36, and 38. Pockets 34 through 38 are installed to the outer or front surface 40 of the apron 14, e.g., by folding over the apron material and securing the folded material back on itself over the front surface, as by stitching 42 at the desired locations to form pockets 34 through 38 of the desired size. The stitching 42 between the first and third pockets 34 and 38 may be positioned to establish the relative size of each of the pockets 34 through 38, with the example of FIG. 2 providing a relatively large first pocket 34 having over half of the total area or volume of the three pockets, a second pocket 36 of intermediate size, and a third pocket 38 which is smaller than the intermediate pocket 36. By forming a variety of different pocket sizes, a variety of different equipment may be conveniently carried in an appropriately sized pocket.

The folded sheet of material used to form the front surface of the pockets 34 through 38 provides a common open upper edge 44 for all of the pockets. This edge 44 may be displaced downwardly from the lower edge 15 of the belt portion 12 if desired, and as shown in FIGS. 1 and 2. By spacing the open upper edge 44 of the pockets 34 through 38 away from the lower edge 15 of the belt 12, and thus providing a distance between the pockets' upper edge 44 and the loops 16 and 18 secured to the belt 12, a can P secured within the loop 16 will remain entirely above the open upper edge 44 of the pockets 34 through 38, thus providing ready access to each of the pockets 34 through 38 below the can P, as shown in FIG. 1. Alternatively, differing numbers and sizes of pockets, as well as a higher or lower upper pocket edge, may be provided as desired.

Further utility and convenience may be provided by the addition of another generally vertically disposed strap or loop 46, extending from the belt portion 12 where one end is stitched thereto, across the front of the apron portion 14 to a buckle 48 secured to the lower edge 50 of the apron portion 14. Adjustment may be provided in the manner described above for the first and second loops 16 and 18. Preferably, the vertical strap or loop 46 is displaced toward one edge of the apron portion 14, so as to preclude blockage or interference with any of the pockets 34 through 38. The vertical loop 46 is preferably placed to the opposite side of the assembly as the two belt loops 16 and 18, in order to reduce interference between articles carried within those loops 16 and 18 and the vertical loop 46 and to balance better the load of the various articles carried by the present utility belt 10.

The present painter's utility belt 10 lends itself to construction from a variety of flexible sheet materials. It has been found that a synthetic fabric material such as polypropylene works well for the belt portion 12, as well as the first and second loops 16 and 18. Such polypropylene material is lightweight, comfortable, and adapts well to use in the present invention. The apron portion 14 may be formed of like material, but a natural material such as canvas, as used in heavier painter's drop cloths, is particularly suitable for use in the construction of the apron portion 14 of the present invention. Such canvas material is relatively paint-proof and takes heavy stitching well, and is quite durable in such use and environment. Other materials may be substituted for the above polypropylene and canvas, if desired.

The present painter's utility belt 10 is used by securing the belt portion 12 about the waist of the user, and securing the two ends of the belt buckle or latch 24 together at the back of the user. This will result in the apron portion 14, which is centered along the length of the belt portion 12, being disposed to the front of the wearer or user, to provide ready access to the pockets 34 through 38 of the apron 14 and also positioning the apron 14 to provide maximum protection for the user against paint drips and spills. The painter or user of the utility belt 10 may then secure a can of paint P within the first loop 16, as shown in FIG. 1 and described above, and use the second loop 18 to secure another article, such as a caulking gun G by means of a cylindrical PVC or other material section of pipe or tube 32. The loops 16 and 18, and any articles contained therein, will be disposed toward one side of the wearer, thus reducing interference directly to the front and providing for greater ease in climbing and other activities typically undertaken while painting. The vertical loop 46 may be used for the carriage of additional article(s). When the job is completed or the painter ceases painting activity, the paint can P is easily removed by unlatching the buckle 20 of the loop 16, and the belt portion 12 removed from the person of the painter using the latch or buckle 24 of the belt portion 12 in a similar manner. The pockets 34 through 38 provide a convenient storage location for the commonly used tools and accessories generally used by a painter, and such tools may be left in the pockets 34 through 38 if desired. Accordingly, the present invention provides great utility and convenience for a painter, and further provides greater safety by allowing a painter to have both hands free for climbing or other activities normally encountered while painting.

It is to be understood that the present invention is not limited to the sole embodiment described above, but encompasses any and all embodiments within the scope of the following claims.

I claim:

1. A painter's utility belt providing for the carriage of painter's tools and articles and at least one paint can having a bail and opposite bail attachment lugs, said belt comprising:

a planar belt portion having an inner surface, an outer surface, an upper edge and an opposite lower edge, a transverse centerline, and opposite first and second ends including mating attachment means equidistantly spaced from said transverse centerline, with said outer surface having a first loop and a second loop secured thereto, said first loop and said second loop each being openable and adjustably closeable;

said belt portion further having an apron portion connected to and depending therefrom with said apron portion having an inner surface, an outer surface, and a bottom edge, with a plurality of pockets formed on said outer surface of said apron portion and said pockets each having an open upper edge providing access thereto, and;

said first loop and said second loop both being displaced to one side of said transverse centerline of said belt portion and being located intermediate said upper and lower edges and said apron portion being centered relative to said transverse centerline of said belt portion, whereby;

said painter's utility belt is adapted to be secured about the waist of a painter with said apron portion disposed to the front of the painter and said attachment means of said belt portion disposed to the back of the painter, said first loop is adapted to be secured about a paint can below the bail attachment lugs to provide support thereby for the can such that said can overlaps said apron portion and other painter's tools and articles are adapted to be placed within said pockets of said apron portion and said second loop to provide for ease of access thereto by the painter.

2. The painter's utility belt of claim 1 wherein:

said pockets of said apron portion extend upwardly from said bottom edge of said apron portion with said open upper edges of said pockets of said apron portion being downwardly separated and spaced apart from said lower edge of said belt portion, whereby;

a paint can secured within said first loop of said belt portion is held above said open upper edges of said pockets to provide ready access to said pockets.

3. The painter's utility belt of claim 1 wherein:

said first and second ends of said belt portion define a length therebetween, and said apron portion-extends substantially along at least one half of said length of said belt portion.

4. The painter's utility belt of claim 1 wherein:

said apron portion includes a first, a second, and a third pocket.

5. The painter's utility belt of claim 4 wherein:

said first pocket has a greater width than said second pocket, and said second pocket has a greater width than said third pocket.

6. The painter's utility belt of claim 5 wherein:

said first pocket has a width greater than the combined width of said second pocket and said third pocket.

7. The painter's utility belt of claim 1 wherein:

said first loop is larger than said second loop.

8. The painter's utility belt of claim 1 including:

a length of tubular material secured within said second loop.

9. The painter's utility belt of claim 8 wherein:

said second loop and said length of tubular material secured therein are adapted to hold and support a caulking gun therein.

10. The painter's utility belt of claim 8 wherein:

said length of tubular material is formed of PVC pipe.

11. The painter's utility belt of claim 1 including:

an openable and adjustably closeable vertically disposed loop having a strap portion connected to and extending downwardly from said belt portion to mating attachment means for forming said vertically disposed loop secured to said bottom edge of said apron portion.

12. The painter's utility belt of claim 11 wherein:

said vertically disposed loop is displaced to a side of said belt portion opposite said one side of said transverse centerline of said belt portion to which said first loop and said second loop are displaced.

13. The painter's utility belt of claim 11 wherein:

at least said vertically disposed loop is formed of polypropylene fabric material.

14. The painter's utility belt of claim 11 wherein:

said mating attachment means of said vertically disposed loop comprises a side latch buckle.

15. The painter's utility belt of claim 1 wherein:

said first loop and said second loop each respectively include mating attachment means comprising side latch buckles, and said mating attachment means of said belt portion comprises a latch buckle.

16. The painter's utility belt of claim 1 wherein:

at least said belt portion and said first and second loops are formed of polypropylene fabric material.

17. The painter's utility belt of claim 1 wherein:

at least said apron portion and said plurality of pockets of said apron portion are formed of canvas material.

* * * * *